US008285174B2

(12) United States Patent
Noguchi

(10) Patent No.: US 8,285,174 B2
(45) Date of Patent: Oct. 9, 2012

(54) COLOR ELECTROPHOTOGRAPHIC IMAGE FORMING APPARATUS HAVING A CARTRIDGE SUPPORTING MEMBER

(75) Inventor: Tomio Noguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/179,944

(22) Filed: Jul. 11, 2011

(65) Prior Publication Data

US 2011/0262181 A1 Oct. 27, 2011

Related U.S. Application Data

(62) Division of application No. 12/564,215, filed on Sep. 22, 2009, now Pat. No. 8,010,014.

(30) Foreign Application Priority Data

Sep. 29, 2008 (JP) ..... 2008-249588
Sep. 16, 2009 (JP) ..... 2009-214091

(51) Int. Cl.
*G03G 21/18* (2006.01)

(52) U.S. Cl. ..... 399/113; 399/110; 399/111; 399/119

(58) Field of Classification Search ..... 399/99, 399/107, 110–113, 119, 121
See application file for complete search history.

(56) References Cited

U.S. PATENT DOCUMENTS 5,758,232 A 5/1998 Ikunami
6,324,362 B1 11/2001 Yokoyama et al.
7,158,735 B2 1/2007 Murayama et al.
7,463,847 B2 12/2008 Sato
7,486,907 B2 2/2009 Noguchi et al.
7,567,769 B2 7/2009 Noguchi et al.
7,660,549 B2 2/2010 Noguchi et al.
7,715,746 B2 5/2010 Tanabe et al.
7,715,752 B2 5/2010 Sakurai et al.
7,761,024 B2 7/2010 Imaizumi et al.
7,894,733 B2 2/2011 Tanabe et al.
7,907,866 B2 3/2011 Imaizumi et al.
7,937,020 B2 5/2011 Sakurai et al.
7,953,340 B2 5/2011 Tanabe et al.
2005/0117934 A1 6/2005 Murayama et al.
2006/0140674 A1 6/2006 Sato
2007/0160380 A1 7/2007 Imazumi et al.
2007/0160384 A1 7/2007 Sakurai et al.
2007/0160385 A1 7/2007 Noguchi et al.
2008/0031656 A1 2/2008 Okabe
2008/0159774 A1 7/2008 Tanabe et al.
2008/0159781 A1 7/2008 Noguchi et al.
2008/0292355 A1 11/2008 Sakurai et al.
2009/0047039 A1 2/2009 Noguchi et al.
2009/0129812 A1 5/2009 Kawanami et al.
2010/0046980 A1 2/2010 Imaizumi et al.
2010/0142996 A1 6/2010 Tanabe et al.
2010/0158563 A1 6/2010 Tanabe et al.
2010/0209139 A1 8/2010 Sakurai et al.

*Primary Examiner* — David Porta
*Assistant Examiner* — Casey Bryant
(74) *Attorney, Agent, or Firm* — Fitzpatrick, Cella, Harper & Scinto

(57) ABSTRACT

A color electrophotographic image forming apparatus detachably mounts cartridges and includes a support supporting a cartridge, movable between inside and outside positions, an outer wall having an opening through which the support passes through when moving between the inside and outside positions, and a guide supporting the support to linearly move between the inside and outside positions so that when the support is in the outside position, the guide supports the support so that a downstream side thereof is pivotable downwardly about an upstream side of the support with respect to a movement direction to the outside position from the inside position. In this state, the cartridge is mounted to the support from above the support and is dismounted upwardly of the support.

7 Claims, 15 Drawing Sheets

(a)

(b)

COLOR ELECTROPHOTOGRAPHIC IMAGE FORMING APPARATUS HAVING A CARTRIDGE SUPPORTING MEMBER

This application is a divisional of U.S. application Ser. No. 12/564,215, filed Sep. 22, 2009, now allowed.

FIELD OF THE INVENTION AND RELATED ART

The present invention relates to a color electrophotographic image forming apparatus for forming an image on a recording material in the state that a plurality of cartridges are dismountably mounted thereto.

Here, the color electrophotographic image forming apparatus forms a color image on the recording material using an electrophotographic image forming process. The examples of the color electrophotographic image forming apparatus include a color electrophotographic copying machine, a color electrophotographic printer (a color laser beam printer, a color LED printer), and so on, a color facsimile device, a color word processor and so on.

The recording material is a material on which the image is formed by an electrophotographic image forming apparatus, such as paper, an OHP sheet, a label, or the like.

For example, the cartridge is a process cartridge or a developing cartridge, and is dismountably mounted to a main assembly of the electrophotographic image forming apparatus to contribute to an image formation process for forming the image on the recording material. The process cartridge contains an electrophotographic photosensitive drum and at least one of charging means, developing means, and cleaning means as process means, as an integral cartridge, and is dismountably mounted to the main assembly of the electrophotographic image forming apparatus. An example of the process cartridge contains the electrophotographic photosensitive drum and the developing means as the process means integrally, and is detachably mountable to the main assembly. Another example of the process cartridge contains the electrophotographic photosensitive drum and the charging means, the developing means, or the cleaning means as the process means integrally, and is dismountably mounted to the main assembly. The process cartridge which has the electrophotographic photosensitive drum and the developing means integrally is called an integral type. In addition, the process cartridge which has the electrophotographic photosensitive drum and the process means other than the developing means integrally is called the discrete type.

The process cartridge can be mounted and demounted relative to the image formation main assembly by a user. For this reason, the maintenance of the apparatus is easy. The process means acts on the electrophotographic photosensitive drum.

In addition, the developing cartridge has a developing roller, accommodates a developer (toner), and is dismountably mounted to the main assembly, wherein the developer is used by the developing roller in order to develop an electrostatic latent image formed on the electrophotographic photosensitive drum. In the case of the developing cartridge, the electrophotographic photosensitive drum is mounted to the main assembly or the cartridge supporting member as will be described hereinafter. Or, the electrophotographic photosensitive drum is provided in the discrete type process cartridge (in this case, the process cartridge does not comprise the developing means). In addition, the developing cartridge also is detachably mountable relative to the main assembly of the image forming apparatus by the user. For this reason, the maintenance of the apparatus is easy.

As for the cartridge, the integral-type process cartridge and the discrete type process cartridge are included. The cartridge includes a combination of the discrete type process cartridge and the developing cartridge. The cartridge includes the developing cartridge actable on the electrophotographic photosensitive drum, wherein the electrophotographic photosensitive drum is fixed to the main assembly or the cartridge supporting member as will be described hereinafter.

In a known color electrophotographic image forming apparatus, a plurality of process cartridges are dismountably supported on a movable tray movable relative to the apparatus main assembly (US2007/160380). According to this structure, the plurality of process cartridges can simultaneously be inserted into the main assembly. In addition, the plurality of process cartridge can simultaneously be pulled out of the main assembly. Therefore, the operativity can be improved when the process cartridge is mounted to the main assembly or taken out of the main assembly.

SUMMARY OF THE INVENTION

The present invention further develops the prior art described above.

The object of the present invention is to provide a color electrophotographic image forming apparatus, wherein the operativity in the mounting and dismounting, relative to the cartridge supporting member, of the cartridge which is in an upstream side with respect to a movement direction in which the cartridge supporting member is moved from an inside position to an outside position, is improved.

Another object of the present invention is to provide the color electrophotographic image forming apparatus, wherein the operativity in the mounting and dismounting, relative to the cartridge supporting member, of the cartridge which is in the upstreammost part with respect to the movement direction in which the cartridge supporting member moves from the inside position to the outside position, is improved.

Another object of the present invention is to provide a color electrophotographic image forming apparatus, wherein the interference relative to an outer wall of the main assembly is reduced, when the cartridge which is in the upstreammost part with respect to the movement direction in which the cartridge supporting member moves from the inside position to the outside position is dismounted and mounted relative to the cartridge supporting member.

According to the present invention, the operativity in the mounting and dismounting, relative to the cartridge supporting member, of the cartridge which is in the upstreammost part with respect to the movement direction in which the cartridge supporting member moves from the inside position to the outside position, is improved.

According to the present invention, wherein the operativity in the mounting and dismounting, relative to the cartridge supporting member, of the cartridge which is in the upstreammost part with respect to the movement direction in which the cartridge supporting member moves from the inside position to the outside position, is improved.

According to the present invention, the interference relative to an outer wall of the main assembly is reduced, when the cartridge which is in the upstreammost part with respect to the movement direction in which the cartridge supporting member moves from the inside position to the outside position is dismounted and mounted relative to the cartridge supporting member.

According to the present invention, when the cartridge is dismounted and mounted relative to the cartridge supporting member, the height of the cartridge supporting member can be reduced, and therefore, the cartridge mounting and dismounting operation property relative to the cartridge supporting member can be improved.

According to an aspect of the present invention, there is provided a color electrophotographic image forming apparatus for forming an image on a recording material, wherein a plurality of cartridges are detachably mountable to a main assembly of said image forming apparatus, said image forming apparatus comprising a cartridge supporting member for supporting said cartridge, said cartridge supporting member being movable between an inside position inside said apparatus main assembly and an outside position outside said apparatus main assembly; an outer wall; an opening provided in said outer wall, said opening being passed through by said cartridge supporting member, when said cartridge supporting member moves between the inside position and the outside position; a guiding member for supporting said cartridge supporting member movably so that said cartridge supporting member moves linearly between the inside position and the outside position, wherein in a state where said cartridge supporting member is in the outside position, said guiding member supports said cartridge supporting member, so that a downstream side thereof is pivotable downwardly about an upstream side of said cartridge supporting member with respect to a movement direction to the outside position from the inside position, wherein in the state that the downstream side is pivoted downwardly about an upstream side of said cartridge supporting member with respect to a movement direction to the outside position from the inside position, said cartridge is mounted to said cartridge supporting member from above said cartridge supporting member, and said cartridge supported on said cartridge supporting member is dismounted upwardly of said cartridge supporting member.

These and other objects, features, and advantages of the present invention will become more apparent upon consideration of the following description of the preferred embodiments of the present invention, taken in conjunction with the accompanying drawings.

PREFERRED EMBODIMENTS OF THE INVENTION

The preferred embodiments of the present invention will be described in conjunction with the accompanying drawings. However, the dimensions, the materials, the configurations, the relative positions and so on of the constituent parts which will be described hereinafter may be properly changed by one skilled in the art depending on the structures and the various conditions of a device to which this invention is applied, and the scope of this invention is not limited to specific dimensions, materials, configurations, relative positions and so on of the embodiments which will be described below.

First Embodiment

Referring to FIG. 1 to FIG. 10, a color electrophotographic image forming apparatus (image forming apparatus or apparatus) 100 according to the first embodiment of the present invention will be described. Here, the image forming apparatus 100 is a full-color laser beam printer as an exemplary apparatus. A general arrangement and a function of the laser beam printer will be described. The image forming apparatus 100 may not be limited to the full-color laser beam printer, but may be a color electrophotographic copying machine, a facsimile device, and so on.

(Image Forming Apparatus)

Figure 1:
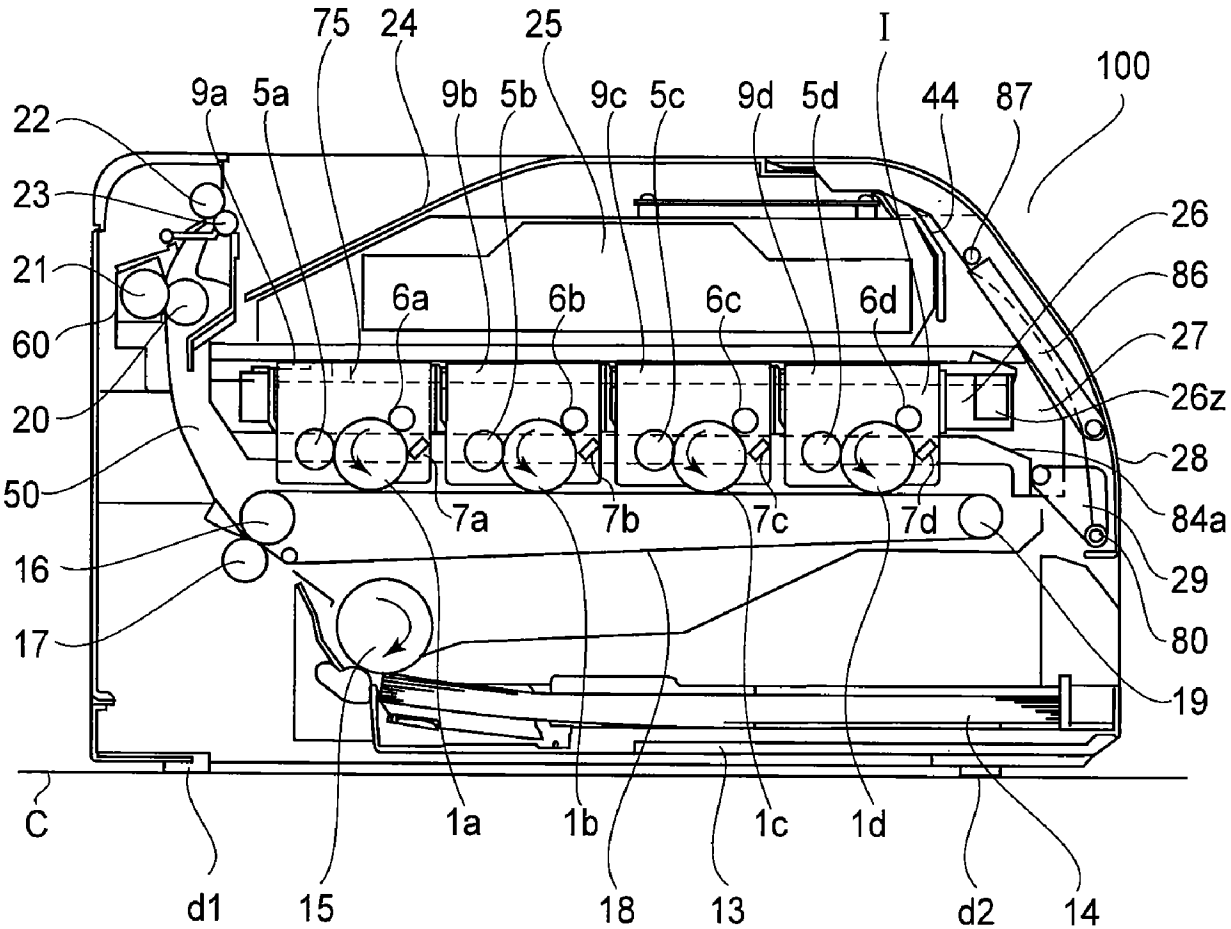
FIG. 1 is a sectional view illustrating an image forming apparatus according to a first embodiment of the present invention.

First, referring to FIG. 1, the structures of the image forming apparatus 100 will be described. FIG. 1 is a sectional view illustrating the structure of the image forming apparatus 100 according to the first embodiment. In addition, in the following description, a front side (front side) of a main assembly A is the side which has an openable and closable door (opening and closing member) 28 (Right-hand side in FIG. 1). The door 28 openably closes an opening (opening) 30 provided in an outer wall 44 of the main assembly A. In other words, the door 28 opens and closes the opening 30. More particularly, the opening 30 is provided in the outer wall 44, and a tray 26 passes through it when a tray 26 moves between an inside position I and an outside position O. In addition, a rear side (backside) of the main assembly A is the side which is provided with a feeding path 50 for a recording material 14 (left-hand side in a FIG. 1) in the opposite side from the side which is provided with the door 28. In addition, the main assembly A is the structure except the cartridge tray (cartridge supporting member) 26 and a process cartridge (cartridge) 9 (9*a*, 9*b*, 9*c*, 9*d*) from the image forming apparatus 100.

In the main assembly A of the image forming apparatus 100, there are provided a feeding cassette 13 for accommodating the sheet 14 (recording material), a feeding roller 15, an intermediary transfer belt 18, a fixing film 20 and a pressing roller 21 of fixing means 60, a laser scanner 25 and so on. The main assembly A comprises a cartridge tray (cartridge supporting member) 26 movable between the inside position and the outside position O of the main assembly A relative to the main assembly A. The tray 26 supports dismountably a process cartridge 9 and (9*a*, 9*b*, 9*c* and 9*d*). Each cartridge 9 integrally includes an electrophotographic photosensitive member of a drum configuration (photosensitive drum) 1 (1*a*, 1*b*, 1*c*, 1*d*) and a developing roller 5 (development member) (5*a*, 5*b*, 5*c*, 5*d*), a charging roller (charging member) 6 (6*a*, 6*b*, 6*c*, 6*d*), and a cleaning blade (cleaning member) 7 (7*a*, 7*b*, 7*c*, 7*d*) as process means which act on the photosensitive drum 1. Each cartridge 9 is dismountably mounted on the tray 26, and is mounted to a mounting portion which is at an image forming position in the main assembly A. In addition, in FIG. 3 and subsequent Figures, the charging roller 6 and the cleaning blade 7 are omitted, for better understanding.

The sheet 14 stacked in the cassette 13 is fed by the feeding roller 15 rotated in the clockwise direction (FIG. 1), and is fed to a nip (transfer portion) between a belt driving roller 16 and a transfer roller 17.

The photosensitive drum 1 starts the rotation in the counterclockwise direction (FIG. 1), and the outer surface thereof is electrostatically charged by the charging roller 6. The charged photosensitive drum 1 is exposed, in accordance with the image information, to a laser beam from the laser scanner 25. By this, an electrostatic latent image is sequentially formed on the photosensitive drum 1. Subsequently, the electrostatic latent image is developed with a developer (unshown) by the developing roller 5. By this, a developer image is formed on the outer surface of the photosensitive drum 1. In addition, the cartridges 9 differ only in the color of the accommodated developer, and structures thereof are the same. A cartridge 9*a* accommodates the developer of a yellow color, and it forms the developer image of the yellow color on a photosensitive drum 1*a*. A cartridge 9*b* accommodates the developer of a magenta color, and it forms the developer image of a magenta color on a photosensitive drum 1*b*. A cartridge 9*c* accommodates the developer of a cyan color, and it forms the developer image of the cyan color on a photosensitive drum 1*c*. A cartridge 9*d* accommodates the developer of a black color, and it forms the developer image of the black color on a photosensitive drum 1*d*.

The developer image formed on the photosensitive drum 1 is transferred onto the intermediary transfer belt 18. In the case where a color image is formed, the developer images of the yellow color, the magenta color, the cyan color, and the black color formed on the photosensitive drums 1 are superimposedly transferred (primary transfer) sequentially onto a transfer belt 18. The transfer belt 18 is an endless belt, and it is rotated while contacting to the photosensitive drums 1, wherein it is stretched by a belt driving roller 16 and a tension roller 19.

The developer image transferred onto the transfer belt 18 is transferred (secondary transfer) onto the sheet 14 fed into the nip between a roller 16 and transfer roller 17.

The sheet 14 onto which the developer image has been transferred is fed to the nip between the fixing film 20 and the pressing roller 21, and it is heated and pressed there. By this, the developer image is fixed on the sheet 14. In this manner, the color image is formed on the sheet 14. In addition, in the case where a monochromatic image is formed on the sheet 14, only the developer image of the black color is formed on the photosensitive drum 1*d*, and it is transferred onto the sheet 14.

The sheet 14 on which the developer image is fixed is discharged to a discharging portion 24 by a discharging roller 22 and a discharging roller 23.

(Exchange System of Process Cartridge)

FIGS. 2-5 are sectional views for describing the exchange system of the cartridge 9. In the image forming apparatus 100, an exchange system of the cartridge 9 will be described.

A tray (cartridge supporting member) 26 is supported through a tray supporting member (guiding member) 27 by the main assembly A. In the state where the tray 26 is supported by a tray supporting member 27, it is slidable between an inside position which is inside of the main assembly A and an outside position O which is outside of the main assembly A. In the inside position I, the tray 26 is inside of the main assembly A, more particularly, when the door 28 is closed, it is inside of the door 28. In the inside position I, the cartridge 9 can carry out the image forming operations. More particularly, in the state that the tray 26 is in the inside position I, the cartridge 9 is placed in the image forming position. The cartridge 9 which is in the image forming position is positioned in the main assembly A, and therefore, it may not support by the tray 26. In the image forming position, the cartridge 9 contributes to forming the image on the sheet 14. In the outside position O, the tray 26 is in the outside of the main assembly A, more particularly, it is in the outside of the opening 30. However, in the state that the tray 26 is in the outside position O, all the parts of the tray 26 and all the parts of the cartridge 9 may not be in the outside of the opening 30. In the outside position O, the user mounts the cartridge 9 to the tray 26, or dismounts the cartridge 9 from the tray 26. In the state in which the tray 26 supports a plurality of cartridge 9 dismountably, it is linearly moved between the inside position I and outside position O through the opening 30. The tray 26 is linearly pulled out of the inside position I to the outside position O by the user. In addition, the tray 26 is linearly pushed in from the outside position O to the inside position I by the user. The tray 26 is horizontally moved in parallel with an installation surface (or floor) C of the device 100 between the inside position I and outside position O. Here, "horizontally" is not limited strictly "horizontally" but may also include the movement of upward or downward component, as required by the tolerance at the time of the manufacturing and/or the smooth movement of the tray 26. Designated by d1 and d2 are legs of the device 100. The device 100 is supported on the installation floor C through the legs d1, d2.

Figure 9:
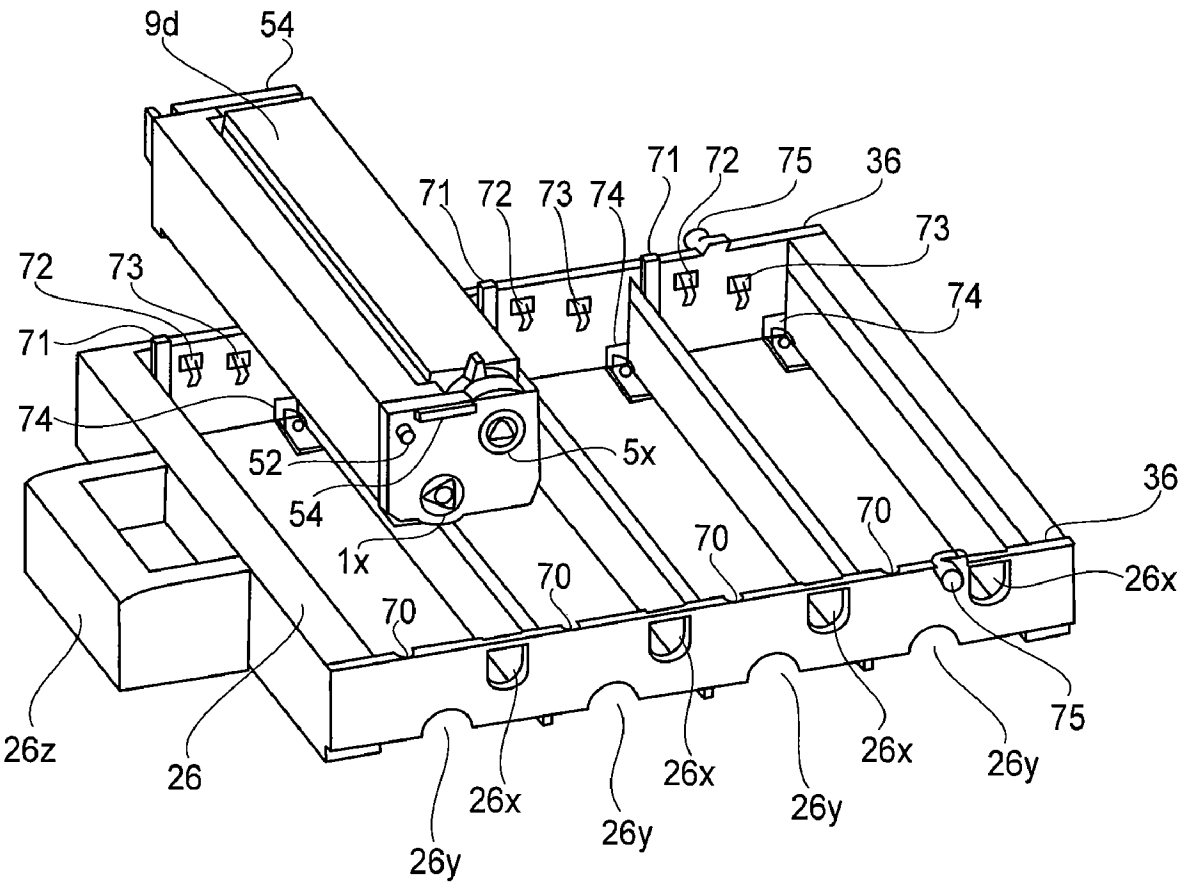
FIG. 9 is a perspective view illustrating the cartridge tray.
Figure 10:
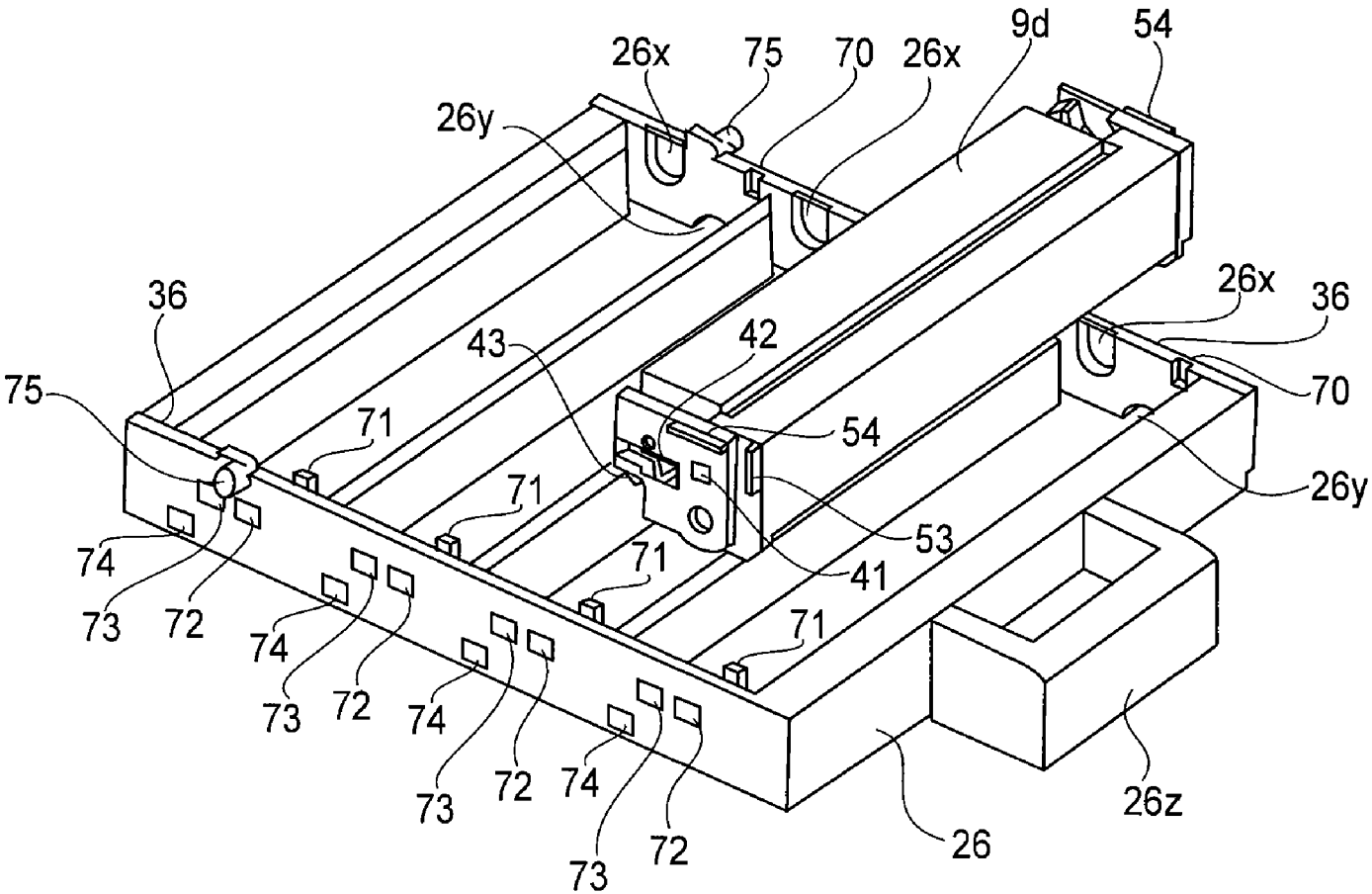
FIG. 10 is a perspective view illustrating the cartridge tray.

The tray 26 is provided with the guide portions 70 and 71 (main assembly side guide portions) for guiding portions to be guided (cartridge side guide portions) 52, 53 of the cartridge 9 (FIG. 10). A portion to be guided 52 (FIG. 9) outwardly projects in the longitudinal direction at the end of a cartridge, 9 with respect to a longitudinal direction (axial direction of the photosensitive drum 1). The portion to be guided 53 (FIG. 10) is provided at the other longitudinal end portion. The guide portion 70 is provided inside of the tray 26 at the end of the tray 26 with respect to the widthwise direction (direction perpendicular to the movement direction of the tray 26). A guide portion 71 is provided at the other widthwise end of the tray 26 inside of the tray 26. The guide portions 70, 71 are provided on each cartridge. The portion to be guided 52 is a cylindrical dowel (projection), and the portion to be guided 53 is a groove extended in the vertical direction in the state in which the cartridge 9 is supported by the tray 26. The guide portion 70 is a groove extended in the vertical direction, and the guide portion 71 is a projection extended in the vertical direction. When the cartridge 9 is inserted into the tray 26, the portion to be guided 52 engages with the guide portion 70 and the portion to be guided 53 engages with the guide portion 71, so that the cartridge 9 is mounted from the upper part to a supporting position (mount position) of the tray 26. In taking the cartridge 9 out of the tray 26, the cartridge 9 is taken out by the upward movement. In other words, the cartridge 9 is downwardly moved relative to the tray 26, and is supported by the tray 26. The cartridge 9 is upwardly moved relative to the tray 26, and is dismounted from the tray 26. The cartridge 9 is supported on the tray 26 by supporting a supported portion 54 (FIG. 9, FIG. 10) provided at the one longitudinal end and the other longitudinal end of the cartridge 9 on the upper surface end 36 of the tray 26. By the combination of the portions to be guided 52, 53 and the guide portions 70, 71 described above, the user mounts the cartridge 9 from above the tray 26. In addition, the user can dismount the cartridge 9 supported by the tray 26, upwardly.

The tray 26 has intermediate electrical contacts 72, 73, 74 electrically connected to electrical contacts 41, 42, 43 of the cartridge 9 (FIG. 10). The contact 41 receives a bias voltage to be supplied to the charging roller 6 from the main assembly A. A contact 42 is connected with the main assembly A to electrically ground the photosensitive drum 1. A contact 43 receives the bias voltage for supplying to the developing roller 5 from the main assembly A. By mounting the cartridge 9 to the tray 26, the corresponding contacts are connected electrically to each other. By mounting the tray 26 to a predetermined position (mounting portion) of the main assembly A, the intermediate electrical contacts 72, 73, 74 of the tray 26 electrically connect with a main assembly side contact (unshown) provided in the main assembly A. By this, the photosensitive drum 1, the developing roller 5 and the charging roller 6 are electrically connected with the main assembly A. In this example, the contacts are provided on a non-driving side of the tray 26, but, this is not restrictive, the contacts may be provided on the driving side. Designated by 1*x* (FIG. 9) is a drum coupling, and it engages with a main assembly side drum coupling (unshown) to receive a rotational force for rotating the drum 1, in the state that the cartridge 9 is in the image forming position. Designated by 5*x* (FIG. 9) is a development coupling, and it engages with a main assembly side development coupling (unshown) to receive a rotational force for rotating the developing roller 5, in the state that the cartridge 9 is in the image forming position. The main assembly side development coupling enters a hole 26*x* provided in the tray 26. The main assembly side drum coupling enters a hole 26*y* provided in the tray 26 (FIG. 9). Designated by 26*z* is a grip, and when the tray 26 is moved, the user grips it.

Figure 2:
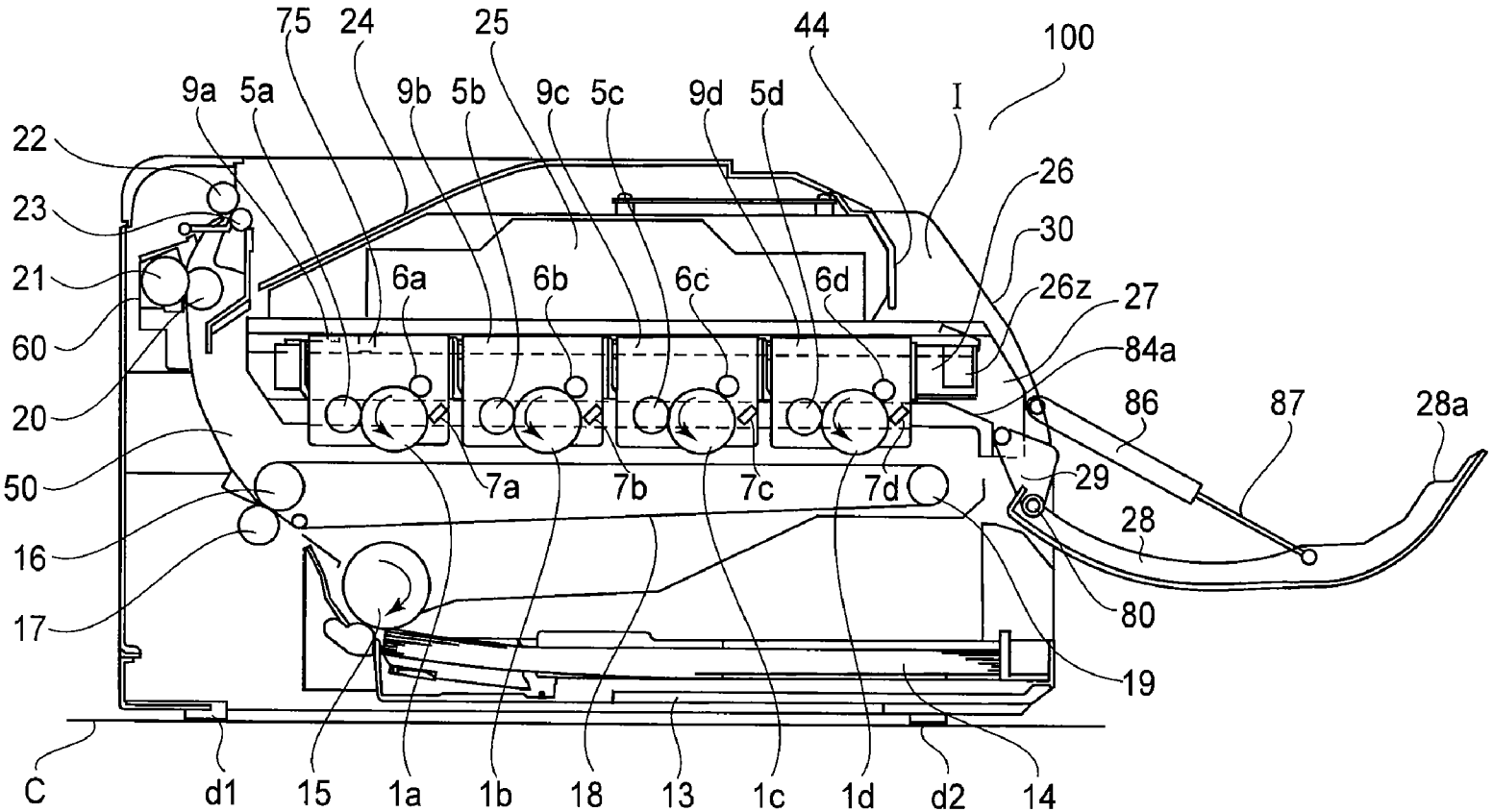
FIG. 2 is a sectional view illustrating the image forming apparatus according to the first embodiment.

The door (opening and closing member) 28 is rotatably provided on the main assembly A. The door 28 opens and closes an opening (opening) 30 provided in main assembly A. FIG. 1 shows a state that the opening 30 is closed by the door 28, and FIG. 2 shows a state that the door 28 is retracted from the opening 30 and the opening 30 is opened. When the user carries out the operations of the cartridge exchange or the like, the user outwardly pushes down the door 28 to release the opening 30. The door 28 is rotationally opened and closed about a shaft 80 provided at the lower limit of the door 28. The shaft 80 is securedly fixed in the main assembly A. In the state that the door 28 is opened by the door link 29, the tray supporting member 27 is pulled out. More particularly, the door link 29 moves the tray supporting member 27 to a door open position (FIG. 2) which is the diagonally right position from a door close position (FIG. 1).

Figure 8:
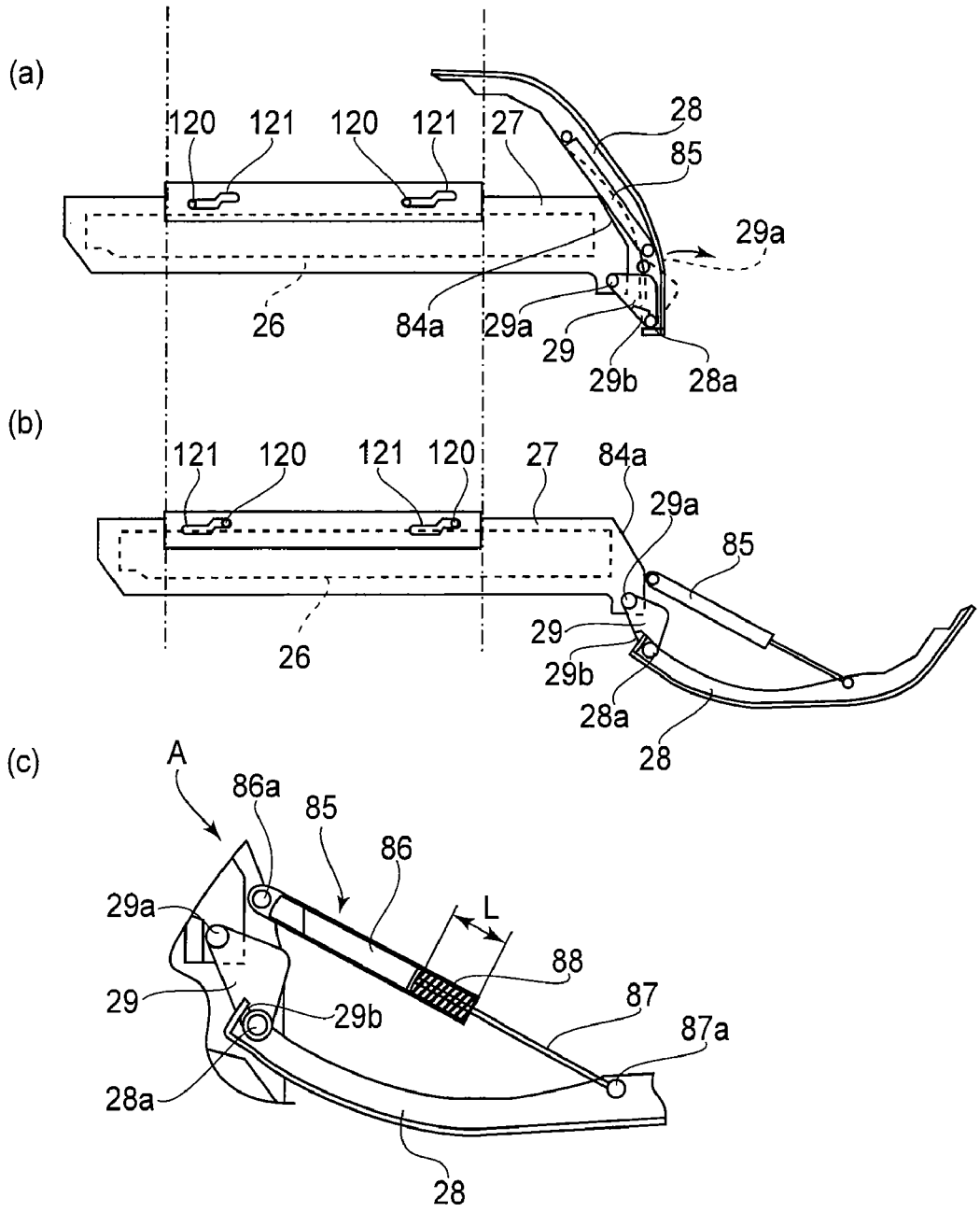
FIG. 8 shows illustrations ((a) and (b)) of a door link, and an illustration (c) of a door damper.

Referring to FIG. 8, the detailed description will be made. FIG. 8 is an illustration of the door link 29. Here, (a) of FIG. 8 shows the tray supporting member 27 in the state that the door 28 is closed. Here, (b) of FIG. 8 shows the tray supporting member 27 in the state that the door 28 is open. When the user opens the door 28 outwardly of main assembly A, the supporting member 27 is pulled out towards the outside position O (right-hand position and FIG. 8) through the door link 29. The link 29 is provided at each of one widthwise end of the supporting member 27 and the other widthwise ends (the direction perpendicular to the movement direction which is the supporting member 27). The one end of the link 29 is mounted to the shaft 80, and the other end is mounted to the one widthwise end. The link 29 is rotatably provided on the supporting member 27.

The supporting member 27 is provided with a boss 120. The main assembly is provided with a groove 121 for guiding the boss 120. When the supporting member 27 is pulled out, the boss 120 moves along the slot 121 to raise the tray supporting member 27 from the position shown in FIG. 1 to the position shown in FIG. 2. This movement of the tray supporting member 27 upwardly moves the tray 26. By this, the photosensitive drum 1 spaces from the intermediary transfer belt 18. Therefore, the tray 26 can be pulled out of the main assembly A.

Figure 3:
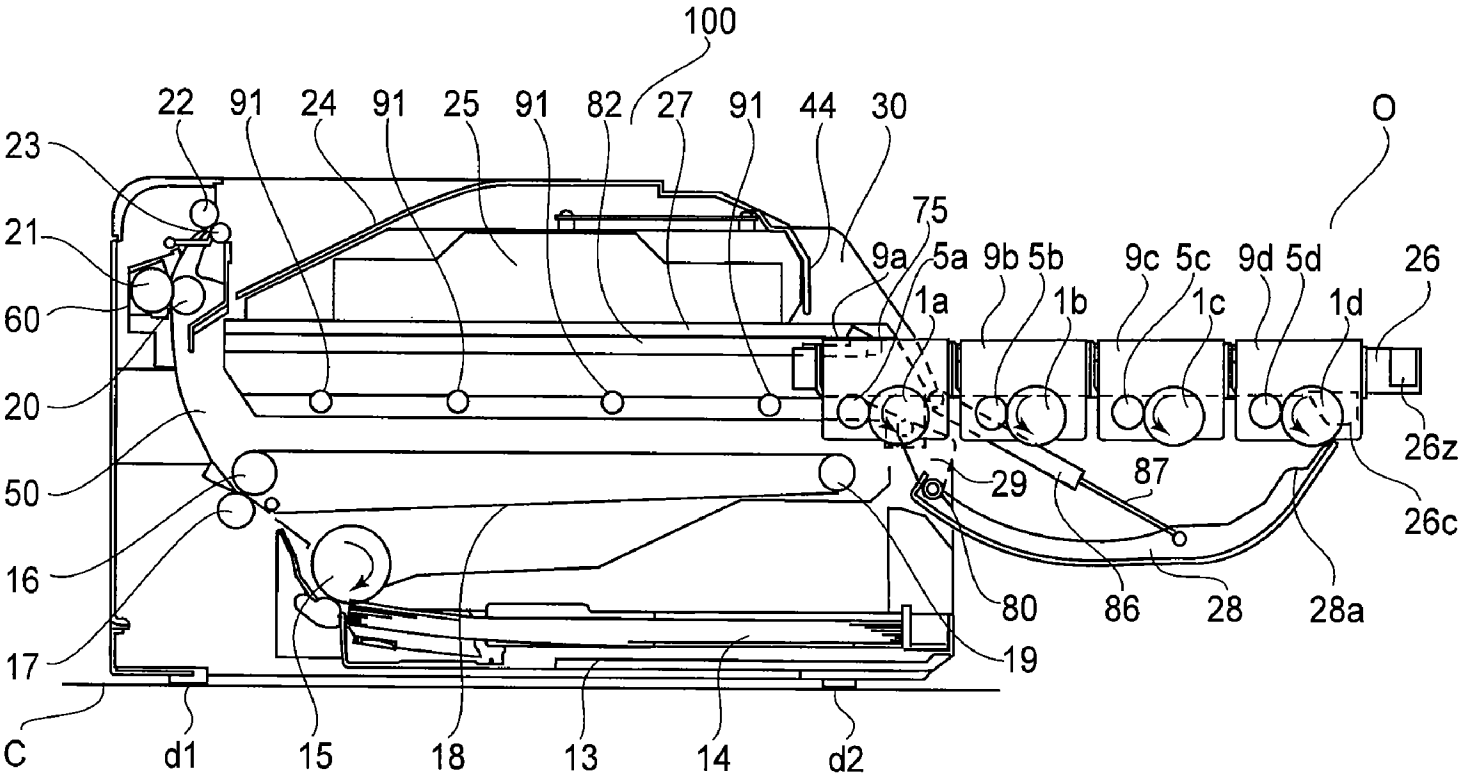
FIG. 3 is a sectional view illustrating the image forming apparatus according to the first embodiment.

The supporting member 27 is provided in the main assembly A, and it supports the tray 26 movably relative to the main assembly A. The supporting members 27 are provided in main assembly A at the one widthwise end and the other widthwise end (with respect to the direction perpendicular to the movement direction which is the tray 26), and are extended toward the rear side of main assembly A from the opening 30. The supporting member 27 has a first guide portion 81 at each of the widthwise ends (FIG. 7 (*b*)). The first guide portions 81 guide both of the widthwise ends of the tray 26. The supporting member 27 is provided with the second guide portions 82 for guiding and supporting the fulcrum shafts provided at both of the widthwise ends of the tray 26 (rotational fulcrums, fulcrums). A fulcrum shaft 75 projects upwardly and outwardly of the tray 26 in an upstream side with respect to the movement direction of the tray 26 to outside position O, from the inside position I (FIG. 9). In addition, the fulcrum shaft 75 is provided at each of the one-end portion and the other end portion of the tray 26 with respect to the direction perpendicular to the movement direction. The tray 26 is movable linearly between the inside of main assembly A and the outside thereof by the first guide portion 81 and the second guide portion 82 of the supporting member 27 (FIG. 2, FIG. 3). In addition, it is moved in parallel with the installation surface C of main assembly A.

Figure 4:
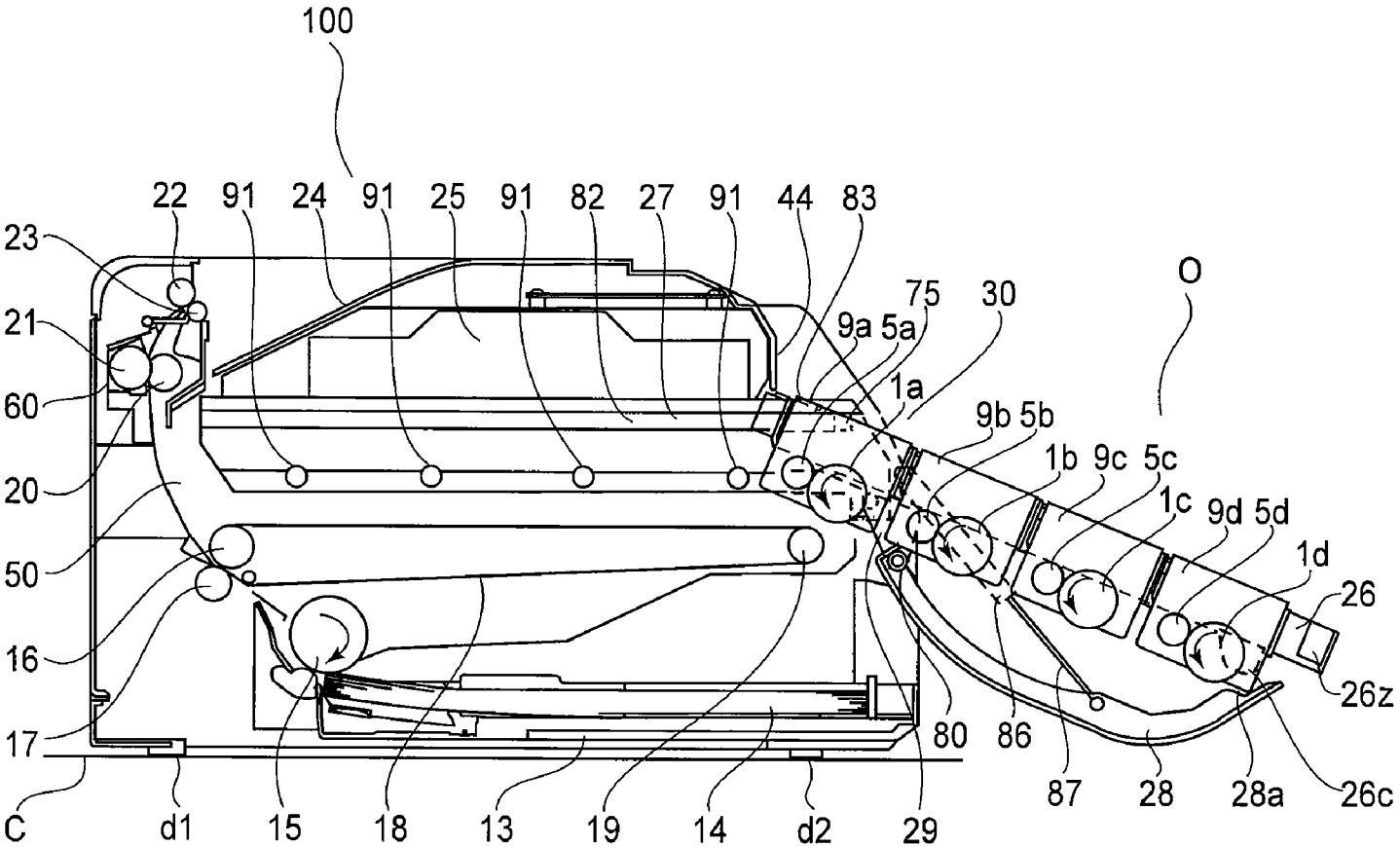
FIG. 4 is a sectional view illustrating the image forming apparatus according to the first embodiment.
Figure 6:
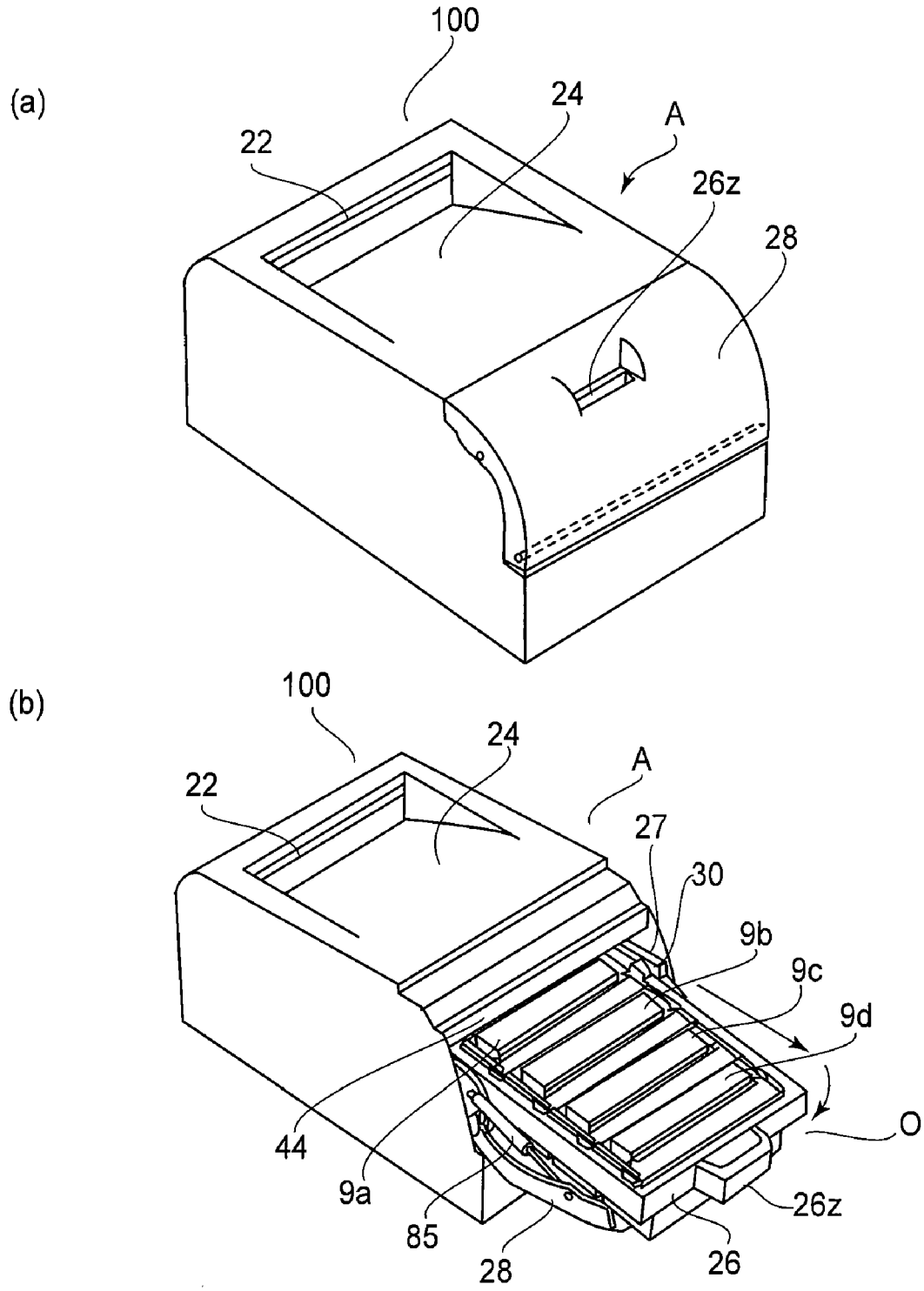
FIG. 6 is a perspective view (a) illustrating the image forming apparatus according to the first embodiment, and is a perspective view (b) illustrating the image forming apparatus according to the first embodiment.
Figure 7:
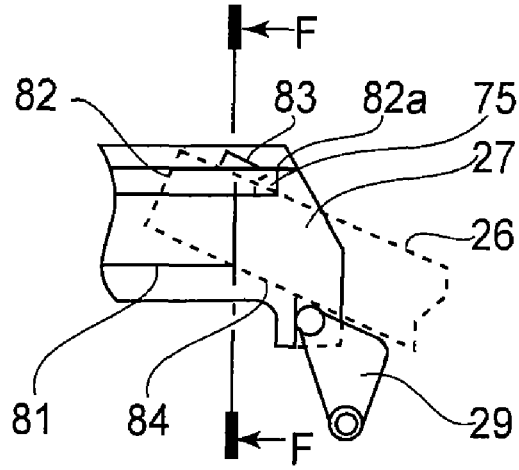
FIG. 7 is a major part sectional view of a tray supporting member for supporting a cartridge tray rotatably.
Figure 7:
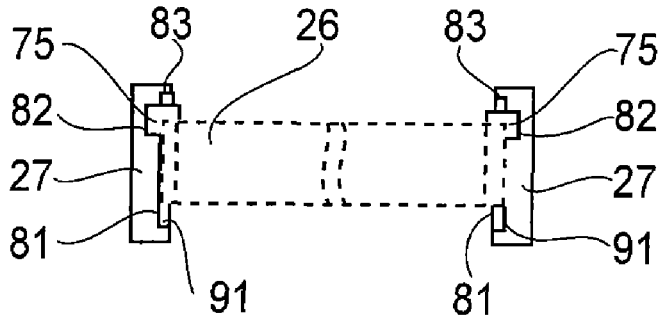
Figure 13:
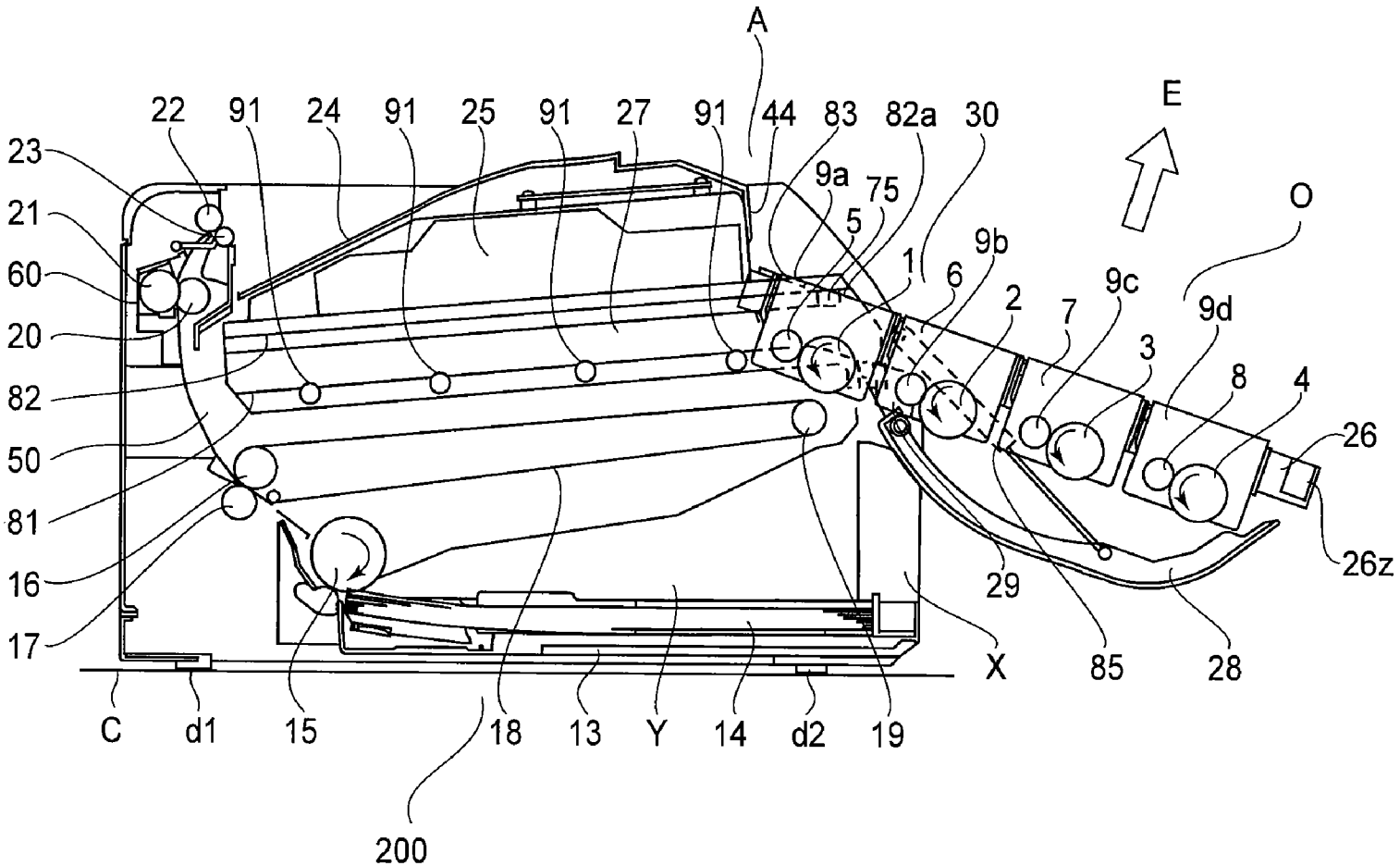
FIG. 13 is a sectional view illustrating the image forming apparatus according to the second embodiment.

Furthermore, when the tray 26 projects toward the outside of main assembly A through the opening 30, the tray 26 is rotatably supported by the second guide portion 82 (FIG. 4, FIG. 6) in the position in which the fulcrum shaft 75 abuts to a free end portion 82*a* ((a) of FIG. 7, and FIG. 13) of the second guide portion 82 ((a) of FIG. 7). More particularly, the tray 26 is downwardly rotatable or pivotable about the fulcrum shaft 75 which abuts to the free end portion 82*a*. The first guide portion 81 is extended from the rear side of main assembly A to the position at which the fulcrum shaft 75 abuts to the free end portion 82*a*. Therefore, the tray 26 loses the supporting by the first guide portion 81 at the position at which the fulcrum shaft 75 abuts to the free end portion 82*a*, and therefore, it is downwardly rotatable (FIG. 3, FIG. 4).

Figure 5:
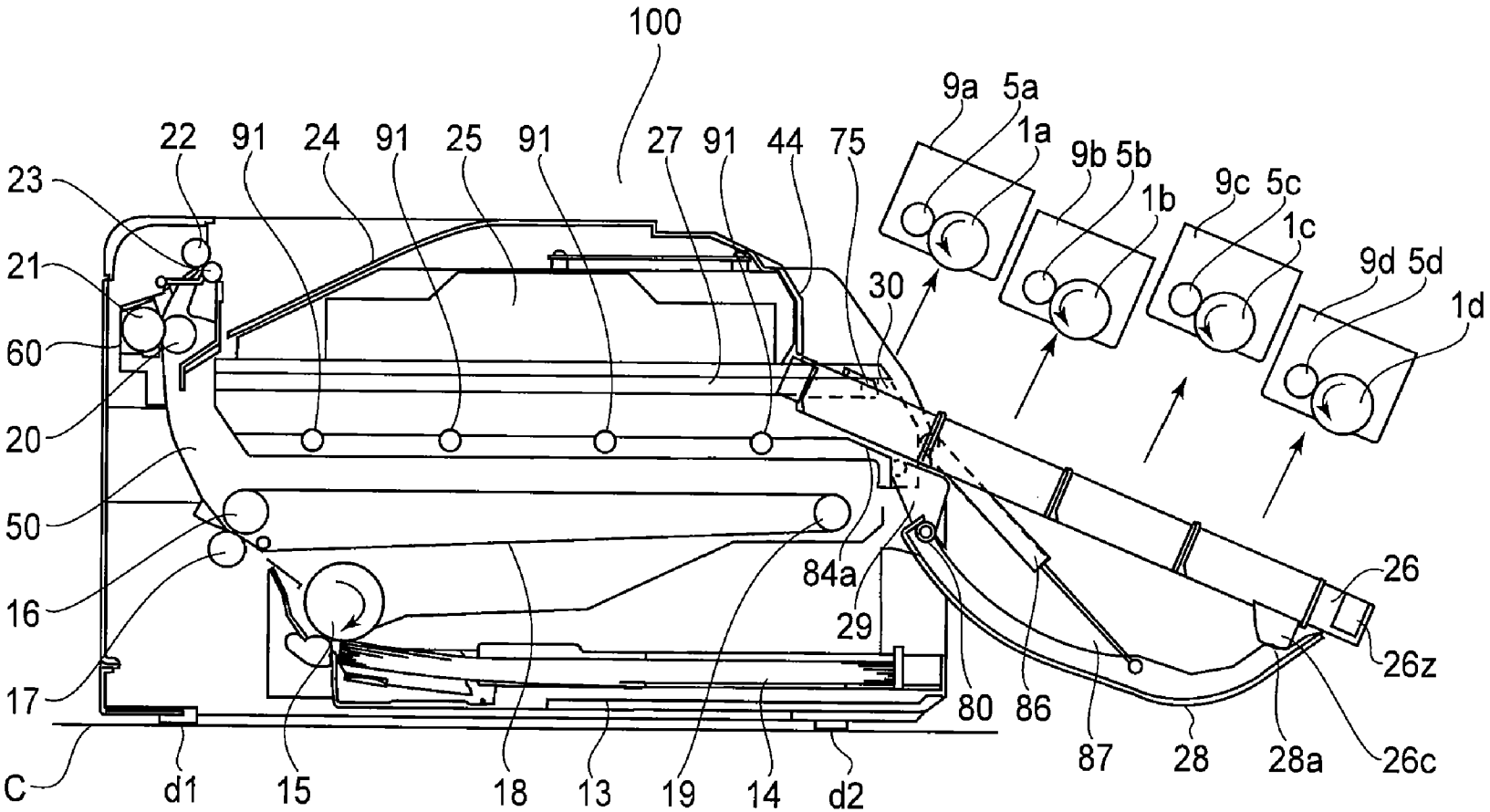
FIG. 5 is a sectional view illustrating the image forming apparatus according to the first embodiment.

According to this embodiment, the tray 26 is rotated downwardly while the free end thereof is supported by the door 28 which receives the force (elastic force) in the direction opposite from the open direction by the damper 85 as will be described hereinafter. As shown in FIG. 7, the downward rotation (inclination) of the tray 26 is regulated by a top stopper 83 provided at an end of the second guide portion 82 and a lower stopper 84 provided at the free end of the first guide portion 81. The state shown in FIG. 4 or 5 is regulated in the downward rotation of the tray 26. In this state, the user mounts and demounts the cartridge 9 relative to the tray 26. More particularly, the tray 26 inclines downwardly in the state that the upstream upper portion with respect to the movement direction is regulated by a stopper 83, and the lower portion is supported by a stopper 84. Since the downward inclination of the tray 26 is permitted the stopper 84 has an inclined surface 84*a* inclined downwardly toward the free end. As has been described hereinbefore, the tray 26 is supported by the supporting member 27 for movement relative to main assembly A.

More particularly, the tray 26 is movable outwardly from the rear side of main assembly A while the lower surfaces of both of the lateral end portions are guided to the first guide portion 81, and the fulcrum shaft 75 is guided by the second guide portion 82. The first guide portion 81 and the second guide portion 82 are provided at the respective widthwise end portions inside the main assembly. As has been described hereinbefore, the supporting member 27 supports the tray 26 movably so that the tray 26 moves linearly between the inside position I and the outside position O. And, in the state in which the tray 26 is in the outside position O, the supporting member 27 supports the tray 26 with a fulcrum (shaft 75) in the upstream side of the tray 26, so that the downstream side is inclinable downwardly. Here, the "upstream" side and the "downstream" side are based on the movement of the tray 26 to the outside position O from the inside position I. As has been described hereinbefore, the supporting member 27 is provided with the first guide portion 81 for supporting the tray 26 linearly movably. In addition, the supporting member 27 is provided with the second guide portion which supports the tray 26 with the fulcrum in the upstream side of the tray 26 which is projected to outside position O through the opening 30, so that the downstream side is inclinable downwardly. Here, (a) of FIG. 7 is a major part sectional view of the tray supporting member 27 which supports the tray 26 rotatably, and (b) is a F-F sectional view of (a).

The tray 26 retractable from main assembly A by opening the door 28 (FIG. 2) is supported and guided linearly by the guide portions 81, 82 of the supporting member 27. And, the tray 26 is outwardly pulled out of main assembly A through the opening 30 (FIG. 3). In other words the tray 26 is pulled out of the inside position I to the outside position O by the user. When the tray 26 is projected from the opening 30 to the outside of main assembly A in this manner, the door 28 in the open position supports the lower portion of the tray 26. By this, when the tray 26 on which the cartridge 9 is mounted is pulled out to the outside of main assembly A, the tray 26 is supported not only by the supporting member 27 but also by the door 28. As has been described hereinbefore, by being pulled out by the user, the tray 26 is moved to outside position O linearly from the inside position I in parallel with installation surface C of device 100 (200). And, the tray 26 is supported in the free end portion thereof by the door 28, in the state in which a horizontal state is maintained, and thereafter, the free end thereof inclines downwardly while being supported by the door 28.

In the present embodiment, the damper 85 as a buffer member (force applying portion material) is provided between main assembly A and the door 28. As shown in FIG. 8 the damper 85 is constituted by a cylindrical portion 86, a damper shaft 87, and the a spring (elastic member) 88 provided in an inside of the cylindrical portion 86. The damper 85 is provided at each widthwise end of a movement path of the tray 26 without interfering with the movement path. The end of the cylindrical portion 86 of the damper 85 is mounted rotatably to main assembly A. The end of the damper shaft 87 is mounted rotatably to the inside of the door 28. The spring 88 is a compression spring. The spring 88 starts the application of an elastic force at the position of length L against the damper shaft 87 pulled out of the cylindrical portion 86. More particularly, when an attempt is made to further open the door 28 from the position shown in FIG. 2, the elastic force of the spring 88 is applied against the damper shaft 87. More particularly, the spring 88 applies, to the door 28, the force (elastic force) in the direction opposite the open direction of the door 28. The door 28 is contacted to the lower surface of the tray 26 pulled out in parallel with installation surface C, in an open position of the door 28 shown in FIG. 2 and FIG. 3. When the user opens the door 28, the door 28 is stopped at the open position. This is because the weight of the door 28 and the elastic force of the spring 88 balance with each other. And, when the tray 26 is pulled out by the outside position O, the door 28 contacts to the lower surface of the tray 26 (FIG. 3). And, the tray 26 is inclined downwardly while the lower surface thereof is supported by the door 28. In this case, the elastic force is a force in the direction of returning the door 28 to the closed position. By this, the tray 26 can be prevented from inclining downwardly suddenly. For this reason, the tray 26 is lowered slowly.

In this manner, the damper 85 rests the door 28 at the position (FIG. 3) in which the tray 26 pulled out in parallel with installation surface C is supported. In this state, the elastic force of the spring (88) and the weight of the door (28) balance with each other (length of the spring 88 is L). The damper 85 supports the pulled-out tray 26 in parallel with installation surface C. In this state, the door 28 starts the lowering slowly by the weights of the tray 26 and the cartridge 9 against the elastic force of the spring 88, while the door 28 supports the free end of the tray 26. Here, the door 28 may not necessarily be at such a position contacted to the lower surface of the tray 26 pulled out horizontally in the open position of the door 28. For example, after the tray 26 pulled out horizontally starts declination, the door 28 may contact to the lower surface of the tray 26. However, if the door 28 contacts to the tray 26 in the horizontal state of the pulled-out tray 26 as with the present embodiment, the tray 26 can be slowly lowered from the initial stage position of the lowering. And, the damper 85 supports the free end of the tray 26 which is regulated in the inclination by the stoppers 83, 84 in a trailing end portion (with respect to the outward movement direction) through the door 28, by the elastic force (FIG. 4). In this state, the tray 26 is rested. The "trailing" end is based on the movement direction of the tray 35 to the outside position O from the inside position I, and it is the upstream side. In addition, the free end is the downstream side. Designated by 28*a* (FIG. 4, FIG. 13, FIG. 15) is a supporting portion for supporting a supported portion 26*c* provided on the lower surface of the tray 26, and it is provided on the door 28. According to this embodiment, the trailing end of the tray 26 is regulated by the stoppers 83, 84, and the free end is supported by the elastic force through the door 28. Therefore, the tray 26 can maintain a lower position (FIG. 4, FIG. 13) in the stable state. More particularly, the tray 26 loses the support of the first guide portion 81 at such a position that the fulcrum shaft 75 abuts to the free end portion 82*a*. And, the tray 26 is pivotable (rotatable) downwardly about the shaft 75. In the present embodiment, the free end of the tray 26 is once supported by the door 28 to maintain the horizontal state (FIG. 3). Thereafter, the tray 26 is inclined while the free end thereof is supported by the door 28 which is slowly moving in the open direction by receiving the elastic force from the damper 85. And, the upper surface of the trailing end of the tray 26 is restricted by the stopper 83, and the lower surface thereof is restricted in the inclination angle by the inclined surface 84*a* of the stopper 84. Since the movement of the shaft 75 is restricted by the free end portion 82*a*, the tray 26 does not separate from main assembly A. And, the free end of the tray 26 is supported by the door 28, and therefore, the inclined state can stably be maintained. In addition, in pushing the tray 26 into main assembly A, the user rotates the tray 26 about the rear end portion (fulcrum shaft 75) thereof to the height at which it is parallel to installation surface C. Thereafter, the user pushes the tray 26 into main assembly A. As has been described hereinbefore, the door 28 is rotatably provided on main assembly A, and openably closes the opening 30. And, the damper 85 (spring 88) is provided between the main assembly A and the door 28, and applies the force, in the direction of returning to the closing direction, to the door 28. In the state that the tray 26 is in the outside position O, it is supported by the door 28 which receives the force (elastic force) applied by the damper 85 (spring 88). In this state, the free end portion inclines downwardly about the rear end portion of the tray 26.

As shown in FIG. 3, in addition, in the first guide portion 81, a portion supporting the lower surface of the tray 26 is provided with rotatable rollers 91 (rotatable members) at a plurality of places (here, four places). By this, when the user moves the tray 26 linearly, the tray 26 can be smoothly moved with a relatively lighter force by the rotation of the roller 91.

As shown in FIG. 3, in the state in which the tray 26 is pulled out to the outside of main assembly A, the tray 26 can be rotated downwardly about the fulcrum shaft 75. In this case, the free end of the tray 26 tends to lower by the weight, but, it inclines downwardly slowly by the function (the elastic force in the closing direction) of the damper 85. Therefore, the tray 26 does not incline suddenly downwardly.

The tray 26 pulled out to the outside of main assembly A through the opening 30 moves slowly from the horizontal position shown in FIG. 3 to the inclined position shown in FIG. 4, while being supported by the door 28 which receives the elastic force of the damper 85. By the damper 85 provided on the door 28, the cartridge 9 supported by the tray 26 is protected from the excessive impact attributable to the downward inclination movement of the tray 26.

As shown in FIGS. 3 and 4, the lower surface of the tray 26 pulled out to the outside of main assembly A through the opening 30 is covered by the door 28. In other words, the cartridge 9 supported by the tray 26 pulled out to the outside of main assembly A is covered in the lower surface thereof by the door 28. For this reason, the unintended contact of the foreign matter to the photosensitive drum 1 is prevented, and the damage on the surface of the drum, such as a flaw, can be prevented.

Figure 14:
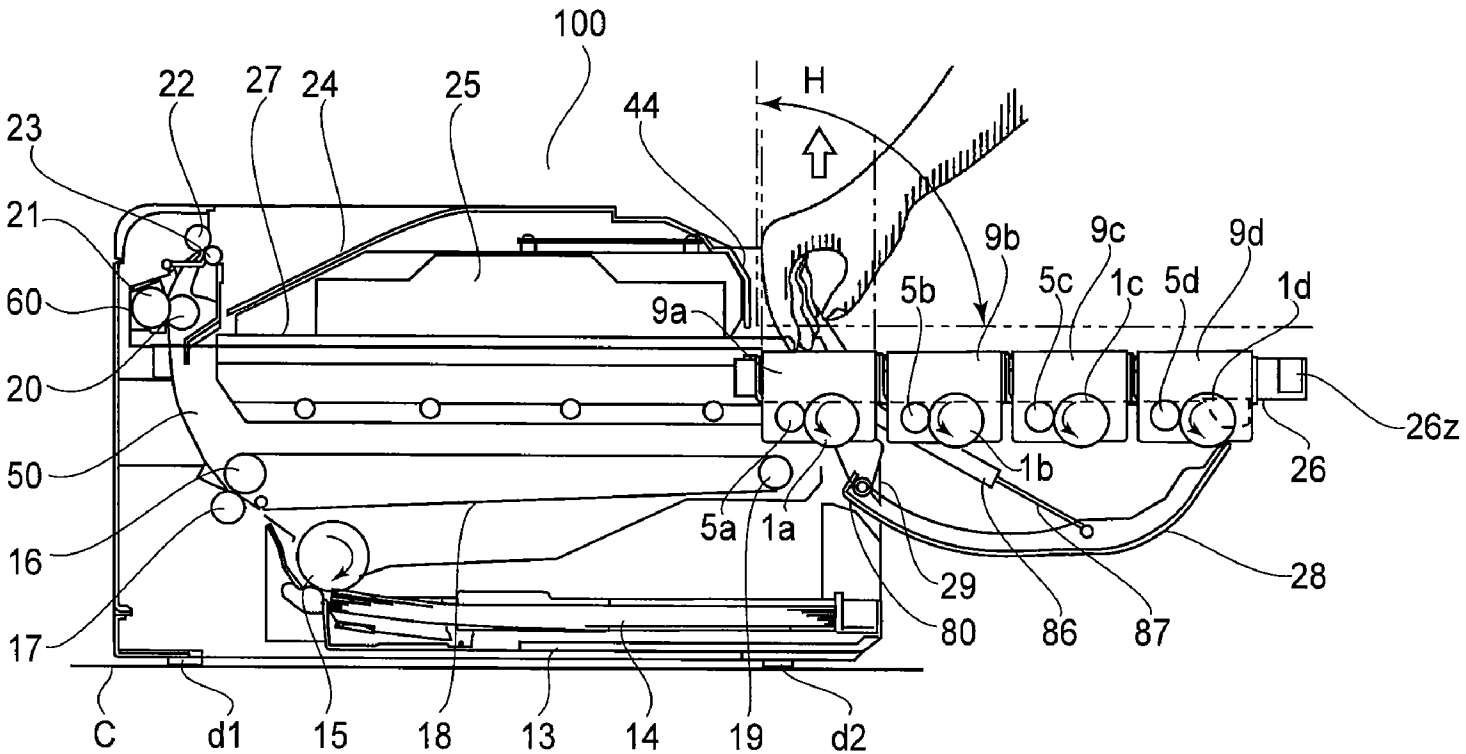
FIG. 14 is an illustration of a dismounting state of a cartridge in a conventional image forming apparatus.
Figure 15:
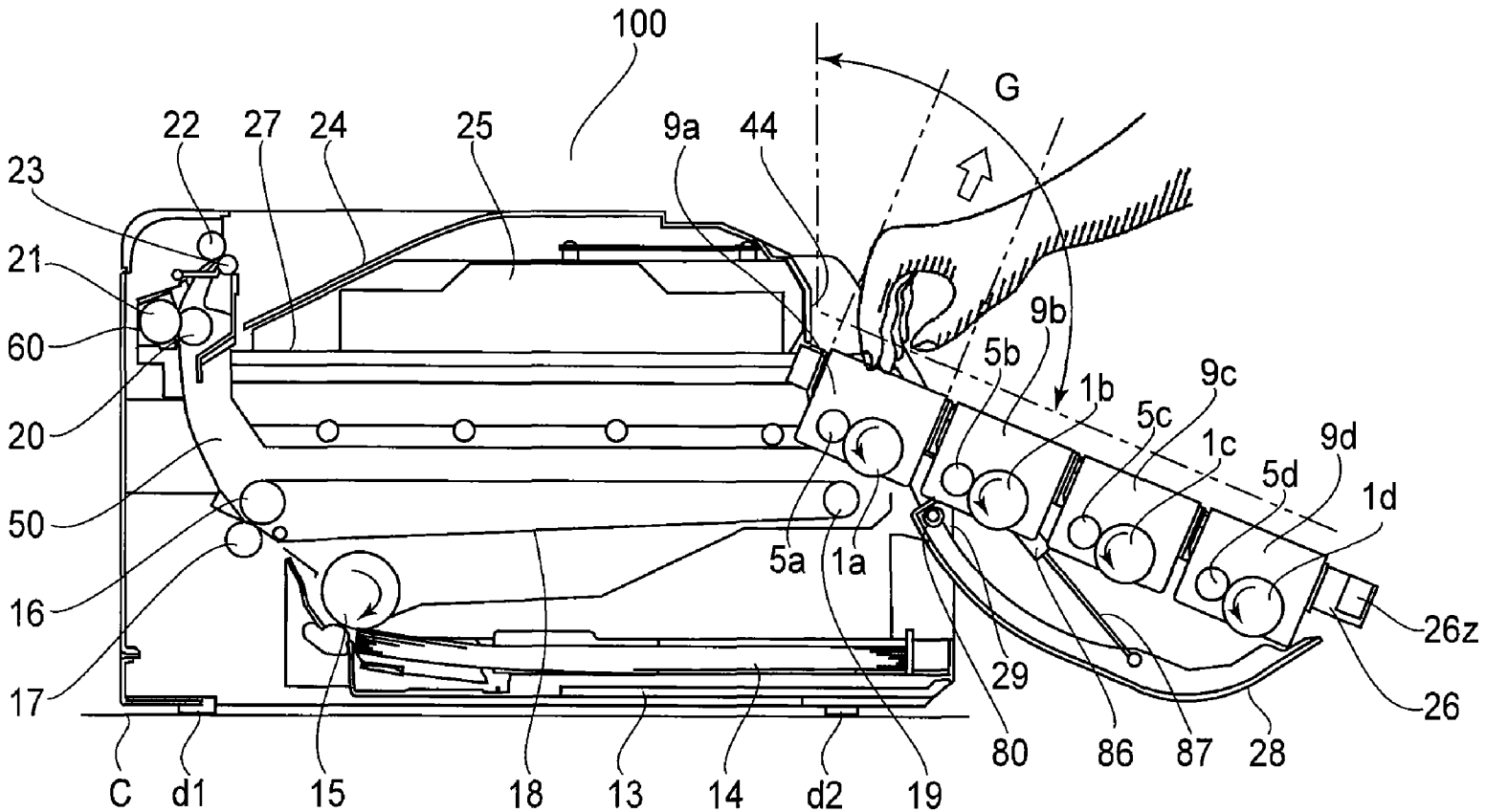
FIG. 15 is an illustration of a dismounting state of the cartridge in the image forming apparatus of an embodiment of the present invention.

As shown in FIG. 3, the tray 26 pulled out linearly to the outside of main assembly A is rotated about the fulcrum shaft 75, so that the free end portion thereof inclines downwardly, as shown in FIG. 4. As shown in FIG. 5, by this, the cartridges can be mounted and demounted not in the vertical direction but in the oblique direction. Therefore, the operativity in the mounting and demounting of the cartridge 9 relative to the tray 26 can be improved. The free end portion of the tray 26 is the downstream side with respect to the movement direction of the tray 26 to the outside position from the inside position. In addition, the rear end portion is the upstream side with respect to the movement direction. Referring to FIG. 14 and FIG. 15, the improvement of the operativity described above will further be described. Unlike the embodiment described above, the cartridge 9 is mounted and dismounted in the horizontal state from the tray 26 in FIG. 14. As will be apparent from the Figure, the user's hand may contact to the outer wall 44. For this reason, the operativity in the case the user mount and dismounts the cartridge 9 relative to the tray 26 deteriorates. More particularly, the mounting and dismounting operation properties of the cartridge (rear side cartridge, 9*a*) which is positioned in the upstream side with respect to the movement direction of the tray 26 to outside position O from the inside position I, are low. Referring to FIG. 15, the case according to an embodiment of the present invention described above will further be described. In the case of the embodiment of the present invention, the tray 26 inclines downwardly. For this reason, the disturbance due to the outer wall 44 when the user mount and dismounts the cartridge 9 from the tray 26 is reduced. As will be apparent from FIG. 15, a space is provided between the user's hand and the outer wall 44. Therefore, the operativity at the time of the user mounting and demounting the cartridge 9 relative to the tray 26 can be improved. In addition, according to this embodiment, the mounting and dismounting operation properties of the cartridge (rear side cartridge 9*a*) which is positioned in the upstream side with respect to the movement direction of the tray 26, can be improved.

Therefore, particularly when the cartridge 9 is downsized, the present embodiment is effective. The angle H of the tray 26 relative to the outer wall 44 is approx. 90 degrees in FIG. 14. The an angle G of the tray 26 relative to the outer wall 44 is approx. 110 degrees in FIG. 15. The downward inclination angle of the tray 26 is properly selected in consideration of the size of the cartridge 9, the height of the outer wall from the tray 26 and the angle of the outer wall, and so on by the person skilled in the art. According to this embodiment, the outer wall 44 is substantially perpendicular to the movement direction of the tray 26. However, this is not restrictive, and the outer wall 44 may be inclined toward inside of main assembly A as it goes upwardly. According to this embodiment, as for the tray 26, the downstream side is inclined downwardly with the fulcrum at the upstream side. And, the user mounts the cartridge P to the tray 26 from above the tray 26 in the state that the tray 26 is inclined. In addition, the user dismounts the cartridge P upwardly from the tray 26 (in the direction of an arrow D in FIG. 12 and the direction of an arrow E in FIG. 13). Here, the above-mentioned word "upwardly" is a direction (the direction of arrow D in FIG. 1 and FIG. 12 and the direction of arrow E in FIG. 13) substantially perpendicular to the inclined surface of the tray 26 of which the downstream side inclines downwardly with the fulcrum at the upstream side.

On the other hand, in mounting the cartridge 9 to main assembly A, the operation is carried out in the order opposite to that of the order of the dismounting operation described above. More particularly, the cartridges 9 are mounted to the tray 26 which is pulled out to the outside of main assembly A and which inclines downwardly (exchange of cartridge 9). Thereafter, the user lifts the tray 26. The elastic force of the damper 85 contributes to the operation for lifting the tray 26 upwardly. And, the tray 26 is returned to the horizontal position (position at which it is insertable into the inside of main assembly A). Thereafter, the user pushes the tray 26 linearly into main assembly A. As has been described hereinbefore, in this case, the user can lift the tray 26 by a relatively light force by the effect of the elastic force of the damper 85 provided in the door 28. Therefore, the load on a user can be reduced.

And, after accommodating the tray 26 in the inside position I of main assembly A, the user shuts the door 28. By this, the supporting member 27 is pushed from the position of FIG. 2 through the door link 29 to the position of FIG. 1. The tray 26 is moved downwardly by the movement of the supporting member 27. The photosensitive drum 1 contacts to the intermediary transfer belt 18, and the cartridge 9 is mounted to the predetermined position (the mounting portion and the image forming position) in main assembly A. FIG. 6 is a perspective view of the image forming apparatus in the state where the door 28 is closed. In the present embodiment, in the cartridge 9 which is in the image forming position, the photosensitive drum 1 contacts to the transfer belt 18.

As shown in FIG. 5, in the image forming apparatus according to the present embodiment, the front side (free end portion) of the tray 26 pulled out of main assembly A inclines downwardly. By this, when the user mounts and demounts the cartridge 9 relative to the tray 26, the retraction/insertion direction of the cartridge 9 relative to the tray 26 is the frontward and angularly upward direction (FIG. 5). This also makes the extraction and insertion of the cartridge 9 relative to the tray 26 easy. In addition, by inclining the pulled-out tray 26 downwardly, the tray 26 is assuredly fixable without moving forward and backward. And, the user can visually confirm the positioning frame inside the tray 26 and so on, directly. This improves the mounting and dismounting properties of the cartridge 9 relative to the tray 26. The front side is the side which is provided with the opening, 30, and is a downstream side with respect to the movement direction of the tray 26 to outside position O from the inside position I. In the present embodiment, the feeding cassette 13 and the tray 26 are operated from the front side.

In addition, according to the image forming apparatus of the present embodiment, the user can carry out all the operations such as the exchange of the cartridge 9, the supplying of the sheet 14 to the cassette 13, and the collection of the output paper and so on, from the same side (front side) of the main assembly.

Second Embodiment

Referring to FIG. 13 from FIG. 11, the image forming apparatus according to the second embodiment will be described. The structure of the image forming apparatus is the same as that of the embodiment described above, and therefore, the like reference numerals as in the foregoing embodiments are assigned to the elements having the corresponding functions In the present embodiment, in the state in which the tray 26 is mounted to the inside position I, the tray 26 inclines downwardly toward the rear side from the front side of main assembly A. In other words, the tray 26 is in the inside position I in the state in which the rear part inclines downwardly. The rear side is the side opposite from the front side. The rear part is the upstream side in the movement direction to outside position O from the inside position I. In addition, the rear part is the back side. More particularly, the first guide portion 81 and the second guide portion, 82 of the tray supporting member 27 incline so that the free end portion of the tray 26 with respect to the movement direction from outside position O to the inside position I, inclines downwardly. In the present embodiment, the guide portions 81, 82 incline downwardly toward the rear side from the front side. This inclination angle is approx. 10 degrees relative to the horizontal direction (installation floor or surface C). As has been described hereinbefore, in the present embodiment, the tray supporting members 27 (first guide portion 81 and second guide portion 82) are inclined so that the free end portion of the tray 26 inclines downwardly. The supporting member 27 is provided in main assembly A, and the upstream side inclines downwardly relative to installation surface C. For this reason, there are following advantages. First, at the time of returning (pushing) the tray 26 into main assembly A, the tray 26 is lifted from the state shown in FIG. 13 to the state shown in FIG. 12, and the tray 26 is pushed into main assembly A to a slight degree, and this is sufficient. Then, the tray 26 enters automatically into the main assembly A by the weight. Therefore, it does not happen that the user is prevented from actuating the main assembly or shutting the door 28 forcibly with the tray 26 stopped at a halfway position, without pushing the tray 26 completely into main assembly A.

Therefore, according to this embodiment, the operativity at the time of the user operating the tray 26 is improved further.

Figure 12:
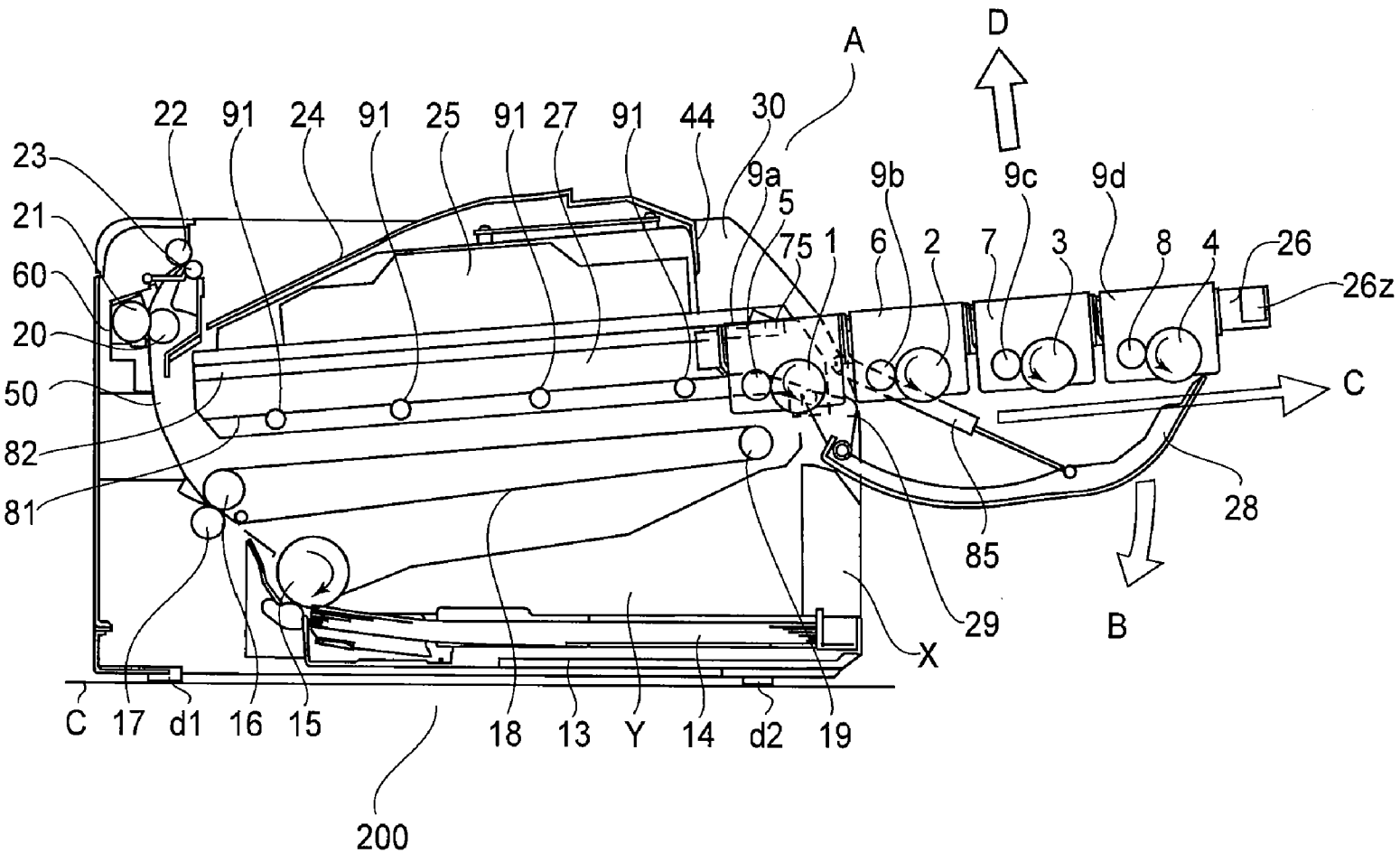
FIG. 12 is a sectional view illustrating the image forming apparatus according to the second embodiment.

Moreover, according to the embodiments, by the structure similar to the embodiment described above, the leading end of the tray 26 with respect to the movement direction to the outside position O from the inside position I can be inclined downwardly (FIG. 13) in the outside position O. As shown in FIG. 13, more particularly, the tray 26 is rotated so that the front side inclines downwardly. By this, the tray 26 can be assuredly fixed, and therefore, the operativity in the operation of taking out the cartridge 9 from the tray 26 can be improved. As shown in FIG. 12, this is because, in the state that the front side of the tray 26 which is in the outside position O inclines upwardly, the height of the tray 26 from installation surface C is large. However, according to these embodiments, the height of the tray 26 which is in the outside position O from installation surface C can be made small. Therefore, the user can mount and demount the cartridge easily relative to the tray 26. Moreover, according to these embodiments, the effects similar to the embodiment described above are provided.

Figure 11:
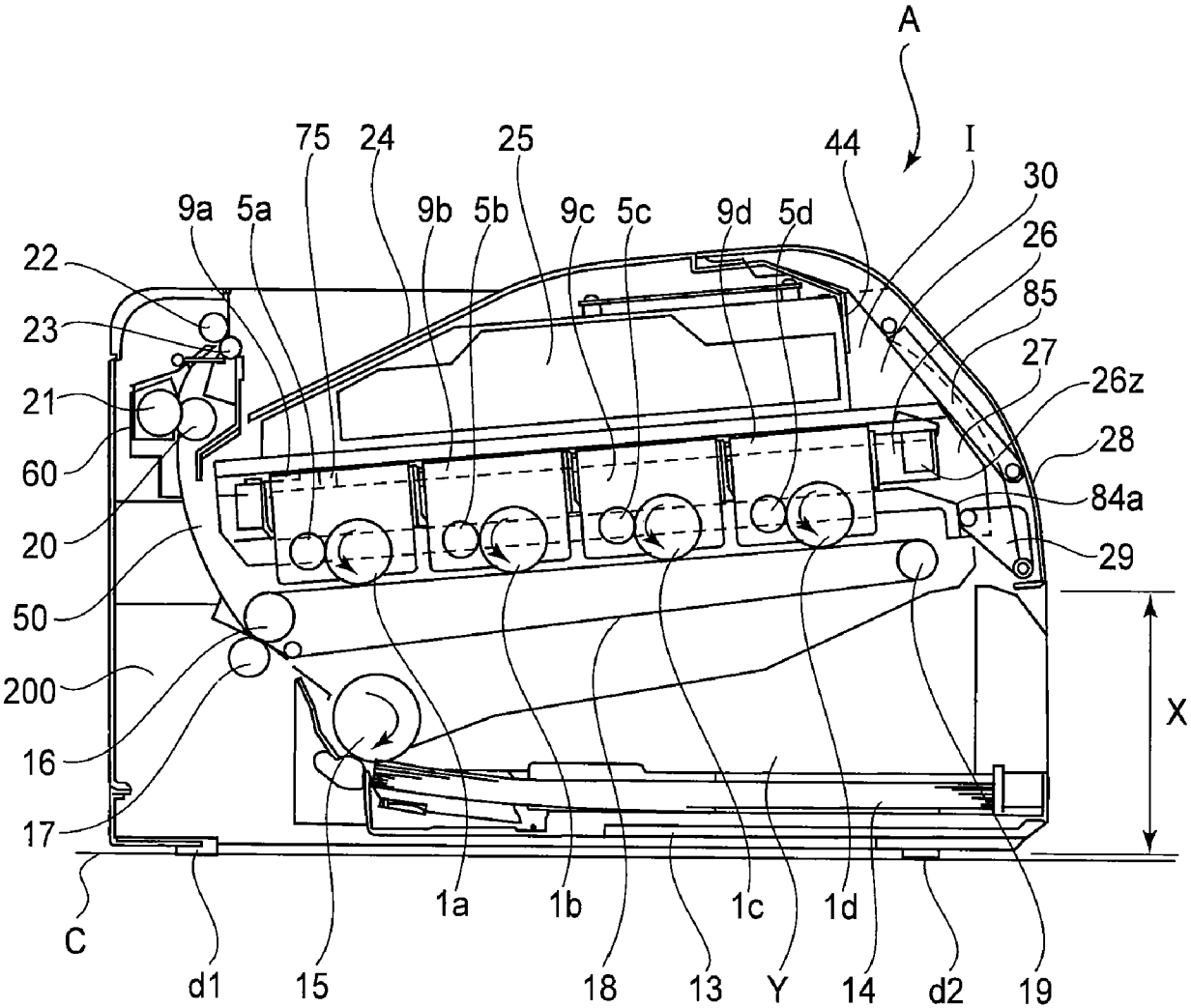
FIG. 11 is a sectional view illustrating an image forming apparatus according to a second embodiment of the present invention.

As shown in FIG. 11, in addition, according to these embodiments, in an inside of main assembly A, not only the tray 26 but the intermediary transfer belt 18 can be inclined. More particularly, they can be inclined downwardly toward the rear side of the main assembly from the front side of the main assembly. For this reason, the spacing Y in the main assembly front side can be expanded below the tray 26 and the transfer belt 18 (FIG. 11). Therefore, the height of an opening X provided in the main assembly front side can be enlarged in order to facilitate the jam clearance operation in the neighborhood of a feeding roller 15 provided in a lower part of them in the main assembly rear side. Accordingly, the operativity of the jam clearance by the user can be improved. According to the embodiments described above, the cartridge 9 is mounted and demounted relative to the tray 26 from the upper part in the state that the downstream side of the tray 26 inclines downwardly with the fulcrum at the upstream side. In addition, the cartridge 9 supported by the tray 26 can be dismounted upwardly of the tray 26.

Other Examples

In the embodiments described above, although the process cartridge has been exemplified as the cartridge detachably mountable to the main assembly, the present invention is not limited to this. It may be another cartridge if it is detachably mountable relative to a supporting member movably supported by the main assembly. For example, it may be a developing cartridge which has developing means or a drum cartridge which has the photosensitive drum or the like. In addition, although the process cartridge which includes a photosensitive drum, a developing roller, and so on is exemplified as the process cartridge, the present invention is not limited to this. The process cartridge may include the electrophotographic photosensitive member and the process means which acts on the electrophotographic photosensitive member as the integral cartridge, wherein process cartridge is detachably mountable to the main assembly of the electrophotographic image forming apparatus. More specifically, the process cartridge may include the electrophotographic photosensitive member and at least one of the developing means, charging means, cleaning means, and so on as the process means with the integral cartridge.

In addition, in the embodiments described above, four detachably mountable cartridges are used, but this number is not limited but what is necessary is just to select the number properly as desired.

In addition, in the embodiments described above, although an electrophotographic printer is exemplified as the electrophotographic image forming apparatus, the present invention is not limited to this. For example, it may be another image forming apparatus such as an electrophotographic copying machine, an electrophotographic facsimile device, or another image forming apparatus such as a composite machine which combines these functions. In addition, in the embodiments described above, an intermediary transfer member is used, the color toner images are sequentially superimposedly transferred onto the intermediary transfer member, and the developer image carried on the intermediary transfer member is transferred all together onto the recording material, but, the present invention is not limited to these examples. For another example, the image forming apparatus may sequentially transfer the color toner image superimposedly onto a recording material carried on the recording material carrying member. Also in these image forming apparatuses, the similar effects can be provided by using the present invention.

According to the embodiments described above, the operativity in the mounting dismounting operations of the cartridge 9 which is positioned in the upstream side with respect to the movement direction of the tray 26 to outside position O from the inside position I, relative to the tray 26, can be improved. In addition, according to the embodiments described above, the operativity in the mounting dismounting operations of the cartridge 9 which is positioned in the upstreammost side with respect to the movement direction of the tray 26 to outside position O from the inside position I, relative to the tray 26, can be improved. In addition, according to the embodiments described above, at the time of the mounting dismounting operations of the cartridge, 9 which is positioned in the upstreammost side with respect to the movement direction of the tray 26 to outside position O from the inside position I relative to the tray 26, the interference with the outer wall 44 of main assembly A, can be reduced. In addition, according to the embodiments described above, in mounting and demounting the cartridge 9 relative to the tray 26, the height of the tray 26 can be reduced, and therefore, the operativity in the cartridge mounting and demounting relative to the tray 26 can be improved.

While the invention has been described with reference to the structures disclosed herein, it is not confined to the details set forth, and this application is intended to cover such modification or changes as may come within the purposes of the improvements or the scope of the following claims.

This application claims priority from Japanese Patent Applications Nos. 249588/2008 filed Sep. 29, 2008 and 214091/2009 filed Sep. 16, 2009, which is hereby incorporated by reference.

What is claimed is:

1. A color electrophotographic image forming apparatus for forming an image on a recording material, said apparatus comprising:

a main assembly;

a cartridge supporting member movable relative to said main assembly in a state of supporting a plurality of cartridges, said cartridge supporting member being movable between an outer position which is outside said main assembly and in which all of the cartridges are mountable and demountable and an inner position which is inside said main assembly;

a rotatable belt which is disposed below said cartridge supporting member when said cartridge supporting member is in the inner position;

an opening which is provided in said main assembly and through which said cartridge supporting member is movable when said cartridge supporting member moves between the inner position and the outer position; and an openable member movable relative to said main assembly between a closing position for closing said opening and an open position for opening said opening, wherein when said cartridge supporting member is in the outer position, said cartridge supporting member is supported by said openable member in the open position in an inclined state in which a downstream side of said cartridge supporting member with respect to a drawing direction of said cartridge supporting member is lower than an upstream side of said cartridge supporting member.

2. An apparatus according to claim 1, further comprising a guiding member configured to guide the movement of said cartridge supporting member, wherein when said cartridge supporting member is in the outer position, the upstream side of said cartridge supporting member is engaged with said guiding member, and the downstream side of said cartridge supporting member is supported by said openable member.

3. An apparatus according to claim 1, wherein said openable member supports a lower side of said cartridge supporting member when said openable member is in the open position.

4. An apparatus according to claim 1, wherein the drawing direction of said cartridge supporting member crosses an axis of an electrophotographic photosensitive drum supported by said cartridge supporting member.

5. An apparatus according to claim 4, further comprising a feeding cassette accommodating recording materials and capable of being drawn out relative to the main assembly in a direction crossing an axis of the electrophotographic photosensitive drum.

6. An apparatus according to claim 1, wherein each of said cartridges is a process cartridge including an electrophotographic photosensitive drum and process means actable on said electrophotographic photosensitive drum.

7. Apparatus according to claim 1, wherein said rotatable belt is an intermediary transfer belt, onto which developer images are transferred from said cartridges supported by said cartridge supporting member.

* * * * *